United States Patent [19]

Kittscher

[11] Patent Number: 4,883,203

[45] Date of Patent: Nov. 28, 1989

[54] DISPENSING STORAGE CONTAINER AND ASSEMBLY FOR LAUNDRY TREATMENT MATERIAL

[75] Inventor: Peter Kittscher, Kaarst, Fed. Rep. of Germany

[73] Assignee: Henkel Kommanditgeschaft auf Aktien, Duesseldorf, Fed. Rep. of Germany

[21] Appl. No.: 197,870

[22] Filed: May 24, 1988

[30] Foreign Application Priority Data

Feb. 15, 1988 [DE] Fed. Rep. of Germany ..... 3804665

[51] Int. Cl.[4] ..... B67D 5/60

[52] U.S. Cl. ..... 222/143; 222/196; 222/463; 222/568; 141/322; 422/264

[58] Field of Search ..... 222/129, 143, 173, 190, 222/196, 196.1, 192, 460, 461, 562, 565, 566, 568, 570, 573, 463; 422/264, 266, 276; 141/322, 320, 319; 215/329, 331; 220/288, 293

[56] References Cited

U.S. PATENT DOCUMENTS

| | | | |
|---|---|---|---|
| 1,755,944 | 4/1930 | Adams | 215/329 |
| 3,108,722 | 10/1963 | Torongo, Jr. et al. | 222/463 |
| 3,192,923 | 7/1965 | Ackerman | 222/173 |
| 3,620,054 | 11/1971 | Drews et al. | 68/17 A |
| 3,913,808 | 10/1975 | Hill | 222/565 |
| 4,118,957 | 10/1978 | Marcussen | 68/17 A |
| 4,550,862 | 11/1985 | Barker et al. | 222/568 |
| 4,703,872 | 11/1987 | Cornette et al. | 222/158 |

FOREIGN PATENT DOCUMENTS

| | | | |
|---|---|---|---|
| 201376 | 2/1986 | European Pat. Off. | 222/143 |
| 216415 | 1/1987 | European Pat. Off. . | |
| 0230079 | 7/1987 | European Pat. Off. . | |
| 0248341 | 12/1987 | European Pat. Off. . | |
| 1154761 | 9/1963 | Fed. Rep. of Germany . | |
| 1551924 | 11/1968 | France | 215/329 |
| 2157718 | 10/1985 | United Kingdom | 222/463 |

*Primary Examiner*—Joseph J. Rolla
*Assistant Examiner*—Steven M. Reiss
*Attorney, Agent, or Firm*—Ernest G. Szoke; Wayne C. Jaeschke; Real J. Grandmaison

[57] ABSTRACT

Dispensing storage containers and assemblies of such containers secured over the conventional cup-like cap of a bottle designed to contain a supply of laundry treatment material. The dispensing storage containers have a shell housing, a closed base end, an open filling end and a cover including media transfer holes and means for securing it over the filling end of the container to disperse laundry treatment material from the container into the wash during use. The open filling end has a collar forming an opening sufficiently wide to receive and be secured over the cup-like bottle cap during periods of non-use, and the base end of the container preferably includes a flange means to which the cover can be secured on the assembly.

10 Claims, 6 Drawing Sheets

DISPENSING STORAGE CONTAINER AND ASSEMBLY FOR LAUNDRY TREATMENT MATERIAL

BACKGROUND OF THE INVENTION

This invention relates to a dispensing storage container for accommodating and dispensing a laundry treatment material such as a liquid, which container is designed to be attached to a bottle of the laundry treatment liquid as originally packaged and sold and/or as stored as an assembly until the bottle of laundry treatment liquid is empty. The storage container is separated from the bottle of laundry treatment liquid, such as liquid detergent, filled therewith and placed into a washing compartment with laundry to be cleaned, such as within an automatic clothes washing machine. The washing water enters the container, through transfer holes in the cover thereof, to flush the laundry treatment liquid out through the transfer holes into the washing compartment. After each use the empty storage container is reunited with the bottle for subsequent reuse.

STATEMENT OF RELATED ART

One storage container of the aforementioned type is disclosed in European Patent Application EP-OS No. 230,079. The storage container of this publication comprises the cup-like closure cap of the bottle of laundry treatment liquid, which cap is a conventional measuring cup and has a very limited capacity. The shell of the closure cap has a second screw thread at the head end which corresponds to the screw thread on the opposite opening rim and which makes it possible to hold in front of and parallel to the head surface a cover which can be unscrewed from the bottle closure cap and then screwed on over the opening of the bottle closure cap, so that a dispensing storage container for accommodating and dispensing a laundry treatment liquid is formed from the bottle closure cap. Before the cover is screwed on over the rim of the opening, the interior has to be filled with the laundry treatment liquid. The relatively small holes remaining after screwing on of the cover are used for media transfer during the wash cycle: during the tumbling movement of the laundry in the rotating drum of the washing machine, the laundry treatment liquid, for example a liquid detergent, flows out from the media transfer holes while, on the other hand, washing water enters through the holes so that the storage container is flushed out in a continuous cycle. The handling involved in first pouring in the liquid and then screwing the cover onto the rim of the opening is a disadvantage. Another disadvantage is that the storage container is formed with the holding screwthread on its outermost surface which constantly rolls around in the laundry during the wash cycle. This makes the dispensing storage container as a whole relatively unkind to the laundry. This is made worse by the fact that, because it is in the form of a closure cap, the cap shell also has to have outwardly directed annular flange sections. Although the flat form of the known cover advantageously does not increase the stacking height of the correspondingly shaped bottles very much, it makes virtually no contribution towards increasing stacking stability which is important where such bottles are transported stacked in several layers, one above the other, on pallets. Finally, another disadvantage is that, when the dispensing storage container is in use, the bottle of laundry treatment liquid has no cover and remains open.

To obviate the last disadvantage, European Patent Application EP-OS discloses dispensing storage containers made in the form of separate components which are independent of the closure cap and are designed to fit thereon. Although such containers afford the advantage that the dispensing storage container can be lifted off the closure cap and used without the bottle having to be left open through the in-use period, they considerably increase the stacking height of the bottle/dispensing storage container assembly. They also reduce stacking stability.

DESCRIPTION OF THE INVENTION

Figure 1:
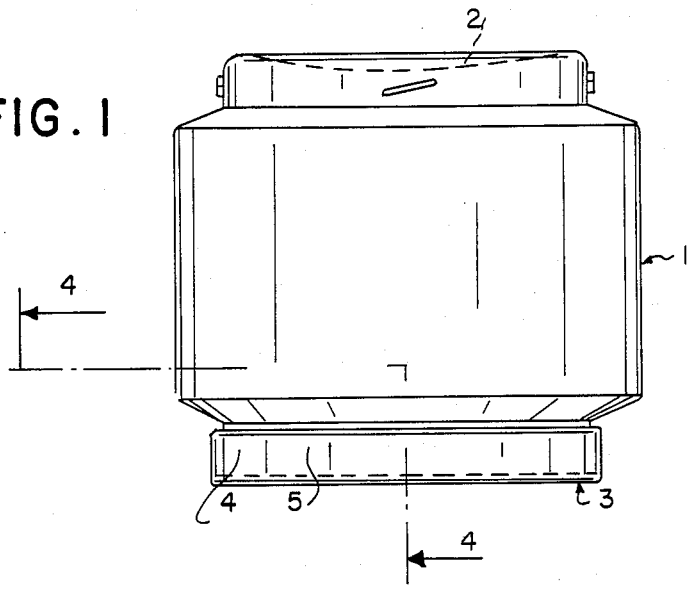
FIG. 1 is an elevation of the dispensing storage container with the cover arranged in front of the filling opening, according to one embodiment of the present invention.

The present invention related to dispensing storage containers of the aforementioned type designed in such a way that, through a certain association of the cover, not only is the use of the dispensing storage container improved, but also its potential applications are extended while, at the same time, assemblies having advantages in terms of packing and storage are obtained.

The present invention provides a dispensing storage container for accommodating and dispensing a relatively large volume of a laundry treatment liquid in a washing machine or the like in a manner which is very laundry-friendly, increases stacking height of assemblies only minimally but increases stacking stability of assemblies very considerably and which, in addition, enables the closure cap of the bottle of laundry treatment liquid to be present on the bottle while the storage container is separated therefrom during use. The container has a large feller opening stabilized by a cover-receiving collar, which enables the storage container to be placed completely over the conventional cup-like closure cap of the bottle of laundry treatment liquid to form an assembly in which the closure cap is received within and very largely disappears into the compartment of the storage container. This provides assemblies having a considerable advantage in terms of packing, delivery and storage to the extent that the large filling opening simplifies the placement of the dispensing storage container over the closure cap of the bottle of laundry treatment liquid. In this way, the dispensing storage container is associated with the bottle in such a way that the height of the overall retail/storage unit, consisting of bottle and dispensing storage container, is only minimally increased. The dispensing storage container is optimally engaged and supported at a stable location on the bottle closure cap. This further promotes stackability, for example on multiple-tier pallets. This stabilization by the cover is further optimized by profiling or contouring the face of the cover to diverge from its planar extension. This compensates the flexural strength of the cover to offset the weakening thereof caused by the plurality of media transfer holes. Thus, the cover may be designed to have a funnel-like recess so that it can be present on the container, over the large filling opening, during filling, and the container can be filled through the cover, avoiding the need for its removal. In this regard the cover preferably comprises a central dome with a recessed groove extending around this dome. This design also affords advantages where the contents are dispensed through an induced surface distribution of the laundry treatment liquid since it increases its effectiveness. The laundry treatment liquid, for example a liquid detergent, flows laminarly down from the dome of the cover into the recess and then passes through the openings at the base of the recess into the storage container during the step of filling the container through the cover. It is possible to establish an optimal ratio between the exit of air through the media transfer holes and the inflow of washing liquid through the remaining cross-sections. Depending on the extent to which the bottle closure cap is received within and disappears into the storage container, it is possible, through sufficiently large overlapping of the bottle closure cap as a whole and, for example, a fixed undergripping or annular bead-annular recess snap-in connection between the two parts, to ensure that the resulting rotatability of the dispensing storage container on the bottle closure cap serves as a kind of child-proof closure or originality closure. The dispensing storage container cannot readily be removed from the bottle closure cap nor can the bottle closure cap plus dispensing storage container be turned to unscrew the bottle closure cap because the dispensing storage container would merely turn or rotate relative to the bottle closure cap. The inner annular edge of the closure cap further increases stability and provides a completely smooth outer surface.

Referring to the drawings, the dispensing storage container illustrated therein comprises a cylindrical storage container 1 made of a suitable plastic material having a suitably-high heat resistance, such as about 100° C., in order to resist the temperature of a washing liquid. The plastic material preferably is transparent to facilitate viewing the level of the detergent added thereto. Graduation lines may also be provided on the surface of the plastic container to facilitate level control. The dispensing storage container 1 has an uninterrupted closed end or base 2, an opposed open end or filling opening 5, and a cover 3. The cover 3 is clipped onto or fastened over a collar 4 comprising an annular flange surrounding the opening 5 and, in this first or use position, extends in front of or over the filling opening 5. The cover 3 is formed with media transfer holes 6 appropriate in size and number/distribution to ensure that, depending on the laundry treatment liquid and/or the washing machine, the contents of the container flow through the holes sufficiently rapidly and are replaced by inflowing washing water.

Figure 2:
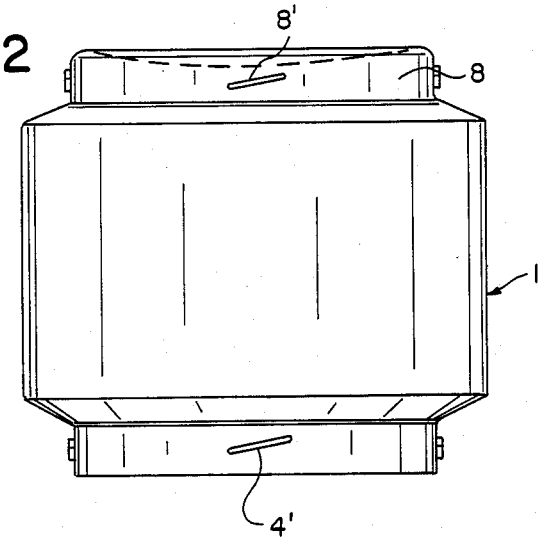
FIG. 2 is an elevation corresponding to that of FIG. 1 but illustrating the cover removed.
Figure 3:
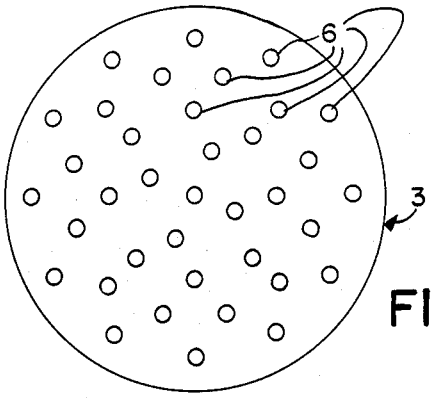
FIG. 3 is a plan view of one form of cover useful according to the invention.
Figure 4:
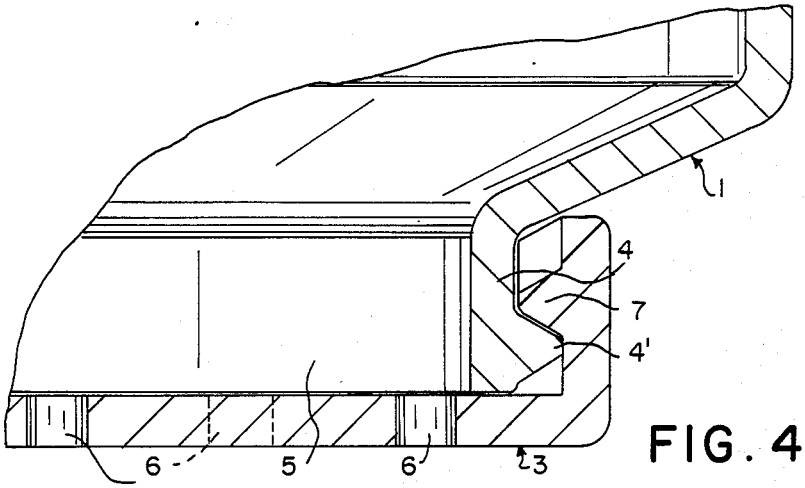
FIG. 4 is a section on the line IV—IV in FIG. 1, illustrating the dispensing storage container in the upside-down position.

The cover 3, which is also made of heat-resistant plastic, preferably is secured on the collar 4 by retaining ribs 4' projecting from the collar 4, as shown in FIGS. 2 and 4, under which engage projections 7 on the inner wall of the skirt or the pot-like cover 3, as shown in FIG. 4. In order to obtain a tight plug/turning connection, the ribs 4' are obliquely arranged.

Figure 5:
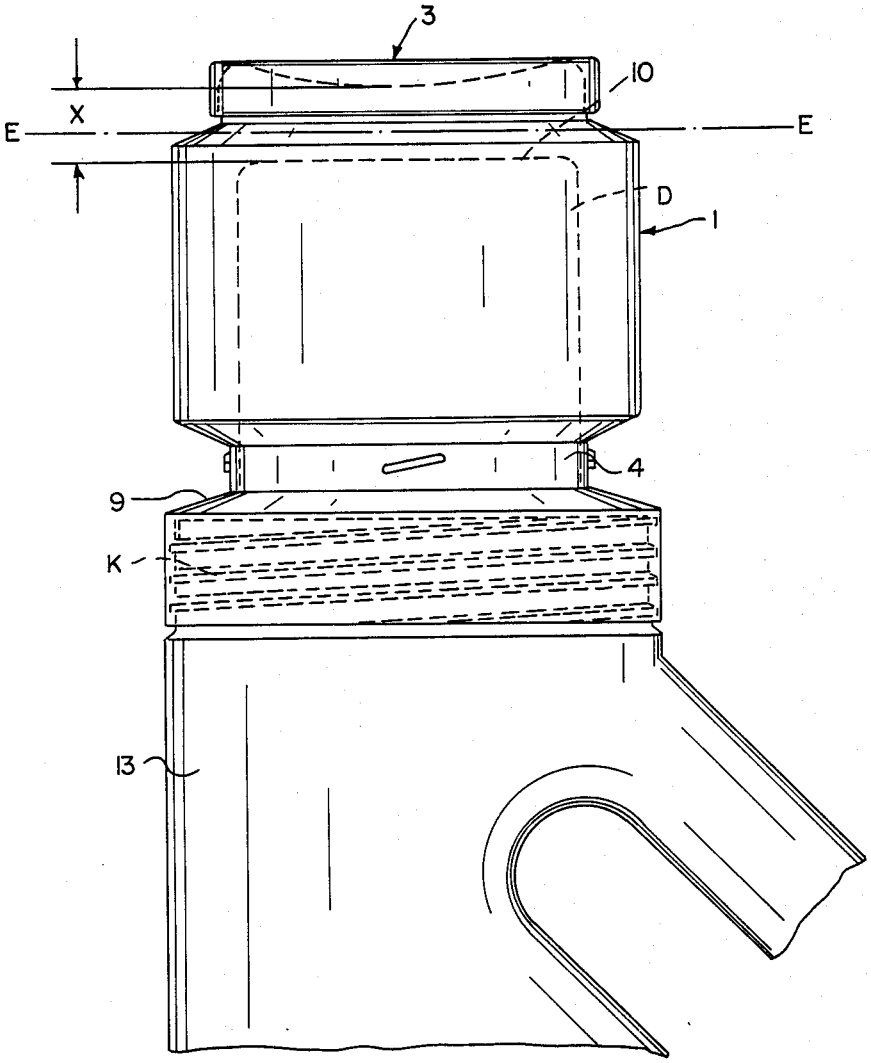
FIG. 5 is an elevation illustrating the assembly of the dispensing storage container of FIG. 2 secured on a bottle closure cap, with the cover attached in a second or storage position.

In addition to this first or use position in front of or over the filling opening 5, the cover 3 may be associated with the dispensing storage container 1 in a second or retail/storage position. To this end, the dispensing storage container 1 is provided with a means for securing the cover to the container during storage, comprising a collar 8 at the closed end or base 2 and having cover-retaining ribs 8'. The retaining ribs 8' are designed and arranged in the same way as the oblique ribs 4' so that the same associative movement exists for securing the cover 3 in both positions. In retail or storage position the cover 3 is seated on the collar 8, as illustrated by FIG. 5, and the filling opening 5 is fully open or uncovered. However, the cover 3 is tightly secured to, but removably associated with the dispensing storage container 1. The fully open filling opening 5 has the advantage, among others, that the entire dispensing storage container can be placed very compactly over a bottle closure cap K present on a retail or storage bottle of the laundry treatment material. In this association, which is shown in FIG. 5, the collar 4 rests on the annular flange or cross-section reducing step 9 of the cap K. The dome D of the bottle closure cap, which is generally intended as a measuring cup in standard closure caps of this type, disappears completely into the interior of the dispensing storage container 1. The head surface 10 of the dome is situated at least a small distance x from the interior surface of the base 2 of the dispensing storage container 1 substantially along the plane E where the collar 8 is disposed, as shown in FIG. 5. This ensures that, in the case of stacked bottles, all the loads acting on the lower bottle/layer of bottles are safely transmitted via the dispensing storage container 1 onto the outwardly extending cap flange or cross-section reducing step 9. This is a very stable zone insofar as it rests directly on the neck 13 of the bottle, in most cases even in interlocking sealing surface contact therewith. In this association, the upside base 2 of the dispensing storage container 1 is also resistant to deformation, even in the absence of central gravitational loads. In addition, the cover 3 also stabilizes this support zone by transferring all compressive loads acting on it to the cylindrical shell of the dispensing storage container 1. Preferably the dome D is cylindrical and has an outer diameter slightly smaller than the inner diameter of the collar 4, as shown by FIG. 5, to provide supporting engagement therebetween.

Figure 6:
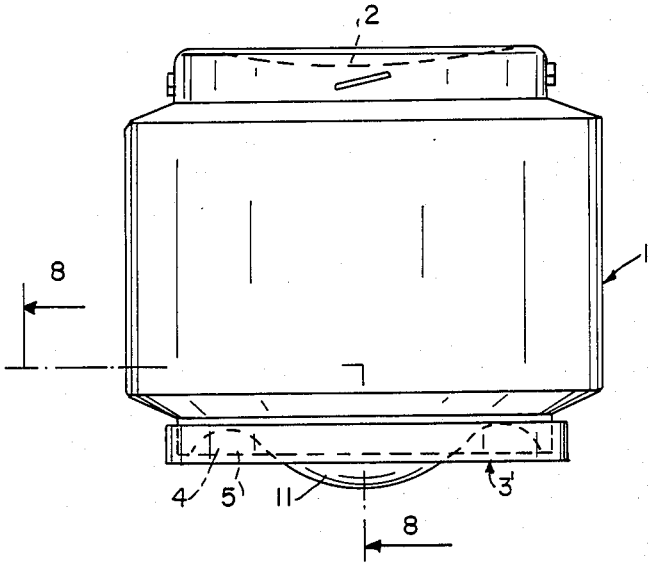
FIG. 6 is an elevation of the dispensing storage container of FIG. 2 with a cover having a preferred shape, different from the cover of FIG. 1, secured over the filling opening.
Figure 7:
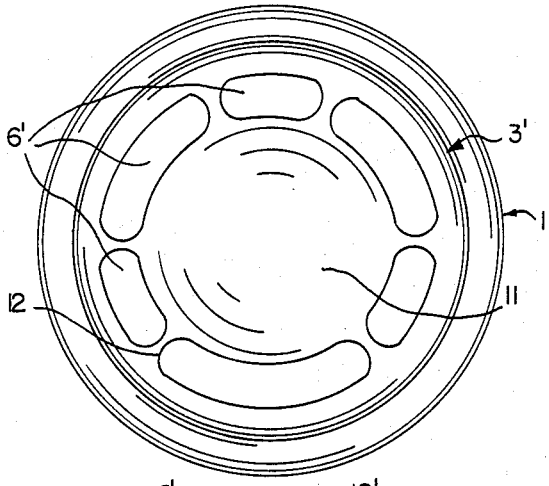
FIG. 7 is a plan view of the cover illustrated in FIG. 6.
Figure 8:
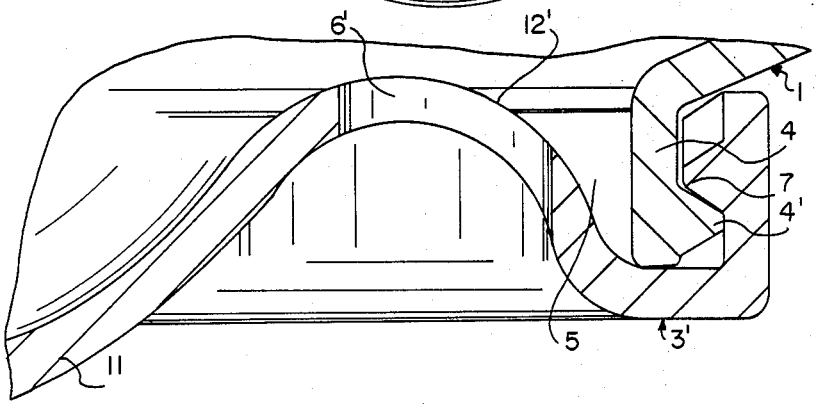
FIG. 8 is a section on the line VIII—VIII of FIG. 6, illustrating the dispensing storage container in the upside-down position.

FIGS. 6 to 8 illustrate a cover 3' having a contoured design which provides optimal utility during use of the dispensing storage container 1. The face of the cover 3' is contoured to diverge from its planar extension in such a way as to form a central, outwardly curved dome 11 which is surrounded by an encircling annular recess or groove. 12. Media transfer holes 6' are provided in the base 12' of the groove, preferably in the form of a circularly-extending row of holes 6'. This design provides a cover 3' which, in addition to its stability-increasing surface contour, also causes the outflowing contents to be distributed over a large area during use in the washing machine and further provides a filling storage space or funnel formed by the groove 12. This design also prevents the holes 6' from being covered or blocked by the items of laundry during use.

Figure 9:
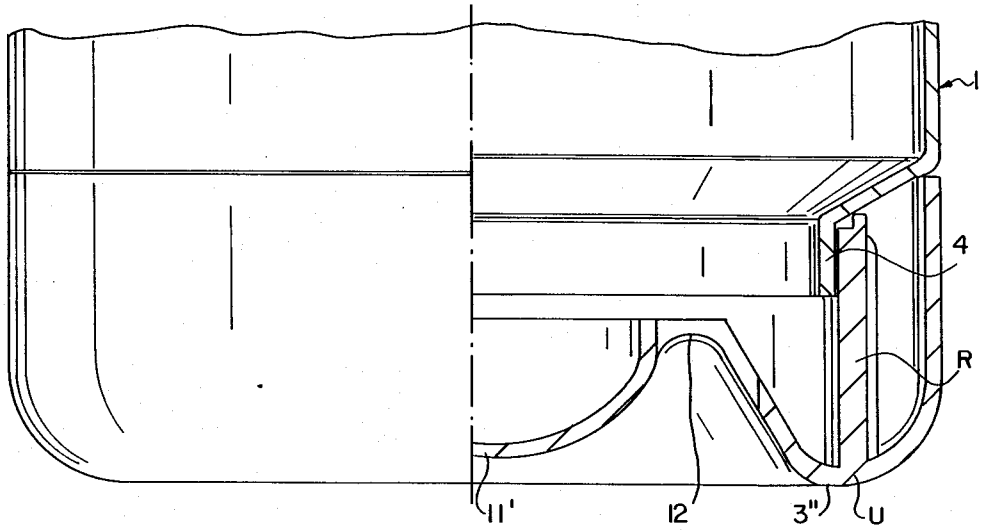
FIG. 9 is a cross-section through the attached cover according to another embodiment of the present invention, illustrating the dispensing storage container in the upside-down position.
Figure 10:
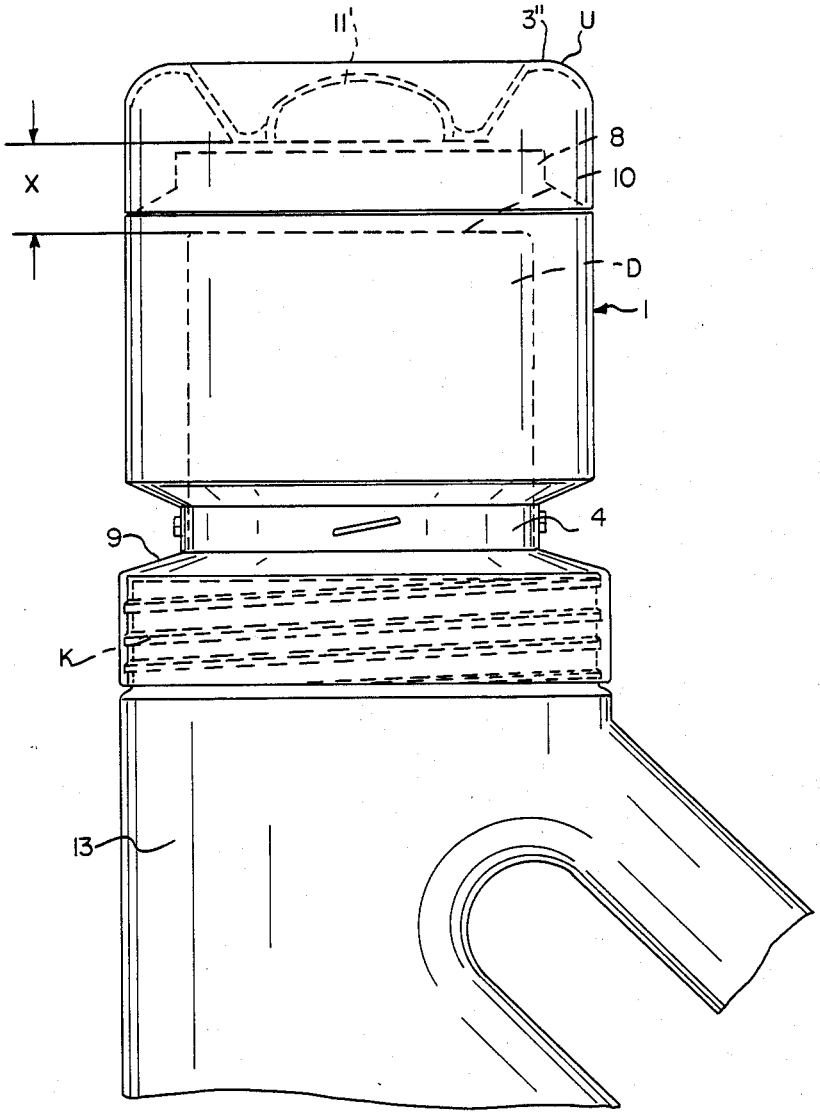
FIG. 10 is an elevation illustrating the assembly of the dispensing storage container of FIG. 2 secured on a bottle closure cap, with the cover of FIG. 9 attached in a second or storage position.

Since the collars 4 and 8 of the container are offset radially inwardly from the maximum diameter of the container 1, sharp edges and overly exposed edges are avoided around the rims of the collar 8 and the cover 3 or 3, during use of the container in a washing machine. At the same time, the thickness of the skirt wall of the cover 3 or 3' decreases the difference between the diameter of the container and the diameter of the collar 4 having the cover thereon. FIGS. 9 and 10 illustrate a preferred embodiment in this regard, providing the container with a completely smooth shell wall. The cover 3'' has an inner annular skirt wall R which is secured to the collar 4 of the container 1, and a spaced outer annular shell wall which merges smoothly with the outer surface contour of the container 1, to avoid damaging the laundry during use. The transition U and its dimensions in relation to the recess or groove 12 provide a stable wave form. The dome 11' is situated only slightly below the plane of the maximum peak or height of the cover 3'' at the transition U.

FIG. 9 illustrates the cover 3'' in use position secured to collar 4 over the filling opening of the dispensing storage container 1. The contour of the cover 3'' permits the container to be filled with cleaning liquid or detergent while the cover 3'' is still attached to the container 1 since the recess or groove 12 functions as a funnel to receive the liquid without spillage. The contour of the cover 3'' also provides a smooth, rounded shell wall at the dispensing end of the container to reduce damage to the laundry being washed.

FIG. 10 illustrates the cover 3'' in retail/storage position, secured to the collar 8 over the closed end or base 2 of the container 1 as an assembly. The wide profile of the cover 3'' facilitates stacking of the assemblies and also distributes the weight of supported stacked assemblies move evenly upon the supporting assemblies.

It is to be understood that the above described embodiments of the invention are illustrative only and that modifications throughout may occur to those skilled in the art.

We claim:

1. In a dispensing storage container for accommodating and dispensing a laundry treatment material within a washing machine or the like, comprising a shell housing having an interior compartment and having an open filling end, a cover having a face containing relatively small media for transfer holes, and holding means for securing the cover over the filling end of the container shell housing for the dispensing of laundry treatment liquid through the transfer holes during use, the improvement wherein the shell housing comprises a wide shell housing having a side wall, a base end and an open, relatively wide filling end surrounded by a cylindrical annular collar spaced radially-inwardly from the side wall, releaseable holding means on said collar, and said cover having a contoured face providing a recessed funnel area containing relatively small media transport holes at the base of said recessed area, and having a depending cylindrical skirt which is designed to overlap and be releaseably fastenable to the holding means on the collar to secure the cover over the filling end of the container, said container, without the cover over the filling end thereof, being designed to be secured over the conventional some bottle cap having an outwardly-extending lower cap flange of a bottle of laundry treatment liquid by the reception of the dome bottle cap within the shell housing of the container and the supporting engagement of the annular collar at the wide filling end of the container with the flange of a said dome bottle cap.

2. A dispensing storage container according to claim 1 in which the holding means on said collar comprises a plurality of spaced oblique retaining ribs which are engaged by a plurality of spaced projections on the inner surface of the overlapping cylindrical skirt of the cover, enabling the cover to be turned on the collar to provide tight engagement with the container.

3. A dispensing storage container according to claim 1 in which said cover has an outer diameter similar to that of the compartment of the container so that the outer surface of the cover merges smoothly with the outer surface of the container.

4. A dispensing storage container according to claim 3 in which said cover comprises spaced inner and outer walls, the inner wall comprising said depending cylindrical wall which is fastenable to the container collar and the outer wall comprising a contoured shell which merges smoothly with the outer surface of the container.

5. A dispensing storage container according to claim 1 in which the contoured face of the cover comprises a central dome area surrounded by a recessed annular groove having said media transfer holes spaced around the base thereof.

6. A dispensing storage container according to claim 5 in which the cover comprises a raised outer peripheral annular rim surrounding said annular groove whereby said groove provides an annular funnel means which facilitates the filling of the container through the cover.

7. A dispensing storage container according to claim 1 in which the base end of the container is provided with a cylindrical annular flange spaced radially inwardly from the side wall of the container and being similar in dimensions to the annular collar at the filling end of the container to permit the cover to be secured over said flange during storage without interference between the base end of the container and the recessed funnel area of said cover.

8. A dispensing storage container according to claim 7 in which the outer surface of said annular flange also comprises a plurality of spaced oblique retaining ribs, similar to the ribs present on the annular collar at the filling end of the container, designed to engage the spaced projections on the inner surface of the cover skirt and to enable the cover to be tightly fastened over the flange at the base end of the container during storage.

9. An assembly dispensing storage container as defined in claim 7 and a bottle designed to contain a supply of laundry treatment material, said bottle having a neck engaged by an enlarged cup-shaped cap designed for use in inverted position as a cup for receiving regulated amounts of the laundry treatment material from the bottle, said cap having an outwardly-extending cap flange adjacent its neck-engaging end, said assembly comprising said bottle and engaged cap, and a said dispensing storage container having the cover thereof secured to the base end of the container and having the bottle-engaged cap inserted through the uncovered filling end of the container and received within the interior compartment of the container, the annular collar at the filling end of the container being supportingly engaged by the cap flange to enable the base end of the engaged container to support another assembly stacked thereover.

10. An assembly according to claim 9 in which said bottle cap has a cylindrical side wall and a closed end, the outer diameter of the side wall being slightly smaller than the inner diameter of the cylindrical collar at the filling end of the container to stabilize the engagement of the cap within the container in position such that the closed end of the cap is spaced from engagement with the interior surface of the base end of the container.

* * * * *

UNITED STATES PATENT AND TRADEMARK OFFICE

CERTIFICATE OF CORRECTION

PATENT NO. : 4,883,203

DATED : November 28, 1989

INVENTOR(S) : Peter Kittscher

It is certified that error appears in the above-identified patent and that said Letters Patent is hereby corrected as shown below:

In Claim 1, at Column 6, line 9, "some" should read --dome--.

In Claim 9, at Column 6, line 63, after "assembly" and before "dispensing" insert --of a--.

Signed and Sealed this

Fifth Day of February, 1991

*Attest:*

HARRY F. MANBECK, JR.

*Attesting Officer*

*Commissioner of Patents and Trademarks*